US005710390A

United States Patent [19]

Ofca

[11] Patent Number: 5,710,390

[45] Date of Patent: Jan. 20, 1998

[54] SHOCK TUBE INITIATING SYSTEM FOR DISPLAY FIREWORKS

[76] Inventor: William W. Ofca, 66 Holt Rd., Hyde Park, N.Y. 12538

[21] Appl. No.: 510,003

[22] Filed: Aug. 1, 1995

[51] Int. Cl.[6] ..... C06C 5/04; C06C 7/00; F42B 3/00

[52] U.S. Cl. ..... 102/275.4; 102/317; 102/318; 102/275.9; 102/275.11

[58] Field of Search ..... 102/317, 318, 102/275.4, 275.9, 275.11, 275.1, 275.8

[56] References Cited

U.S. PATENT DOCUMENTS

| | | | |
|---|---|---|---|
| 900,670 | 10/1908 | Daniels | 102/275.4 |
| 1,275,001 | 11/1918 | Dormer | 102/27 R |
| 3,241,489 | 3/1966 | Andrews et al. | 102/275.1 |
| 3,342,133 | 9/1967 | Strom et al. | 102/27 R |
| 3,851,587 | 12/1974 | Alchorn et al. | 102/27 R |
| 3,893,395 | 7/1975 | Kilmer | 102/275.11 |
| 3,929,072 | 12/1975 | Zapf | 102/275.4 |
| 3,939,772 | 2/1976 | Zebree | 102/275.11 |
| 4,292,896 | 10/1981 | Morrey et al. | 102/275.8 |
| 4,424,747 | 1/1984 | Yunaw | 102/275.2 |
| 4,495,867 | 1/1985 | Mitchell, Jr. et al. | 102/275.4 |
| 4,607,573 | 8/1986 | Thureson et al. | 102/275.8 |
| 4,660,474 | 4/1987 | Dias dos Santos | 102/275.8 |
| 4,667,599 | 5/1987 | Brand | 102/275.4 |
| 4,938,141 | 7/1990 | Gallant | 102/275.4 |
| 5,147,976 | 9/1992 | Laurensou et al. | 102/275.3 |
| 5,327,835 | 7/1994 | Adams et al. | 102/275.11 |
| 5,331,894 | 7/1994 | Wassell et al. | 102/275.12 |
| 5,365,851 | 11/1994 | Shaw | 102/275.6 |
| 5,413,096 | 5/1995 | Sobczak et al. | 102/275.7 |
| 5,417,162 | 5/1995 | Adams et al. | 102/317 |
| 5,423,263 | 6/1995 | Rontey et al. | 102/275.12 |
| 5,463,955 | 11/1995 | Carriere | 102/275.2 |
| 5,524,547 | 6/1996 | Kelly et al. | 102/318 |

*Primary Examiner*—Peter A. Nelson
*Attorney, Agent, or Firm*—Schmeiser, Olsen & Watts

[57] ABSTRACT

A system for initiating shock tube which has a low cost of manufacture, is relatively impervious to moisture, and initiates the shock tube reliably is described. The initiating system comprises a thermal input initiator device, a thermal enhancing output device, and a length of shock tube. The thermal input initiator device converts the thermal flame energy to percussive energy that travels as a signal wave along the shock tube at a speed of 6500 ft/sec. The signal wave hits the thermal enhancing output device and is converted back into thermal energy that is capable of reliably initiating display fireworks.

22 Claims, 1 Drawing Sheet

SHOCK TUBE INITIATING SYSTEM FOR DISPLAY FIREWORKS

INTRODUCTION

The present invention relates generally to a system for initiating explosives. In particular, the present invention is concerned with a system for shock tube initiation of display fireworks.

BACKGROUND OF THE INVENTION

In initiation systems for explosive devices such as blasting caps or pyrotechnics, safety features, energy consumption, delay mechanisms, and the degree of reliability are constant issues.

The current methods by which display fireworks are ignited is by pyrotechnic fuse materials, the most common being a material known as "quickmatch". Quickmatch is made from multiple thin strands of cotton twine that have been passed through a slurry of wet black powder. The wet black powder adheres to the cotton twine which is then gathered into a continuous cord and dried. At this stage, the cord is called "blackmatch". The blackmatch is then covered with a continuous close fitting paper sleeve or piping and is now called "quickmatch".

In order to delay the ignition of the pyrotechnics, an unpiped, bare lead-in length of blackmatch is typically employed ahead of the piped quickmatch because the blackmatch burns at a relatively slow rate (1 inch per second) as compared to the quickmatch (20 feet per second).

Quickmatch is used extensively throughout the manufacture and use of exhibition display fireworks to convey remote ignition to display fireworks material and devices. The nature of quickmatch is that it easily ignites from a flame source and burns fiercely to convey ignition flame to other pyrotechnic components of a fireworks display over a safe distance for the remote location of the operator.

Quickmatch, by its nature, is also inherently hazardous. Because quickmatch ignites from relatively low temperature incandescent heat, the sparks during normally operating firework display segments, have the potential of falling on exposed blackmatch in other live segments thereby prematurely igniting the quickmatch to other unplanned sequences in the display making the encounter unsafe, and causing potential injury to display operators or the public spectators.

Another frequently unsafe encounter with quickmatch operation is that the black powder coating on the cotton twine will sometimes break off inside the paper piping during handling, and suddenly stop burning during performance causing a delay while the cotton twine smolders and glows in the form of incandescent heat. The glowing cotton twine will eventually burn along the bare spot and again find the powder coating. When this occurs, the quickmatch will suddenly re-ignite and the flame will rapidly accelerate, quickly completing its burn to a connected pyrotechnics charge. This unsafe characteristic of quickmatch has been known to result in severe injury, including the accidental death of display operators, during its long history of use of more than a hundred years in display fireworks.

Another problem encountered with the use of quickmatch is its hygroscopic nature. In humid climates, the evening atmosphere often brings dew condensation that adversely affects the performance of quickmatch. The paper piping of quickmatch becomes damp, often with the internal black match also absorbing moisture. This causes the quickmatch burn rate to slow down or to perform erratically, thereby affecting the timing and reducing the entertainment value of the fireworks display.

Display fireworks pyrotechnic devices may also be electrically fired from remote locations by conveying electrical energy along electrical wire conductors to an electric match device. The electric match device has a short piece of thin resistance wire that heats when electrical current passes through this resistance wire, also known as a "bridge wire". The bridge wire is coated with pyrotechnic chemical mixture that ignites when the bridge wire heats, thereby conveying ignition flame to the fireworks pyrotechnic device. There have been several reported incidents and accidents attributed to the unintentional ignition of electric matches used for igniting fireworks. Some of the reasons for these unplanned electric match ignitions have been identified as stray electric currents, ground currents, electromagnetic impulse from lightning, static electricity, and radio frequency transmission energy.

Industrial blasting has mitigated some of these problems by utilizing a fuse material known as "shock tube" which is disclosed in U.S. Pat. No. 3,590,739 issued to Per-Anders Person and assigned to Nitro-Nobel AB. (See also: U.S. Pat. No. 4,328,753 to Kristenson et al.; U.S. Pat. No. 4,607,573 to Thureson et al., assigned to Ensign-Bickford Industries, Inc.; and U.S. Pat. No. 4,660,474 to Dias dos Santos, assigned to Britanite Industrias Quimicas Ltda.) Shock tube is a hollow, elongated tube, generally formed from an extruded plastic material having a gas channel running therethrough which has reactive substance distributed as a thin layer on the inner surface of the tube for propagating a percussion wave from one end of the tube to the other.

Shock tube is a relatively inert material that only initiates under the application of high pressure and temperature to the interior gas channel. Although this aspect is highly desirable for storage and transportation, it can be difficult to initiate and therefore various initiator and detonator devices have been developed. For example, U.S. Pat. No. 5,423,263 issued to Rontey et al., assigned to Dyno Nobel, Inc. discloses a detonator-to-shock tube ignition transfer connection for bidirectional explosive transfer from a detonator to one or more shock tubes. (See also: U.S. Pat. No. 5,365,851 issued to Shaw, assigned to The Ensign-Bickford Company, U.S. Pat. No. 5,417,162 issued to Adams et al., assigned to the Ensign-Bickford Company, and U.S. Pat. No. 5,327,835 issued to Adams et al. assigned to the Ensign-Bickford Company.)

The above related art summaries are merely representative of portions of the inventions disclosed in each reference. In no instance should these summaries substitute for a thorough reading of each individual reference. All of the above references are hereby incorporated by reference.

Other methods of initiating shock tube include the use of a percussive primer that is used in firing shot gun shells. The percussive shot gun shell primer is operated with a "shooter" device that holds the percussive primer flame output vent in close proximity to the open end of the shock tube gas channel. The shooter device has a firing pin that operates to strike the percussive primer, thus imparting impact energy to ignite the primer, thereby applying high temperature flame and pressure to initiate the shock tube. This shooter device is fairly expensive and experiences occasional failures, therefore making it unsuitable for display fireworks, which are exactly timed and choreographed.

A final ignition method utilizes a percussive electrical arc from an electrically charged capacitor. Current is run from a capacitor to a coaxial needle like device with a short gap which is inserted into the shock tube. When the current jumps the gap, sufficient percussive energy is released to initiate the shock tube. Again, this method has drawbacks including cost, because of tip erosion, battery wear, purchase price, it is more difficult to use, and the device is still prone to misfire.

Accordingly, there exists a need in the art for an initiator device that is cost effective, reliable, safe, and relatively impervious to the various natural weather conditions that give rise to unreliability such as dampness, static electricity, and lightening strikes.

SUMMARY OF THE INVENTION

It is a principle object of the present invention to provide an improved shock tube initiating system which has a low cost of manufacture, is relatively impervious to moisture, and initiates the shock tube reliably.

It is a further object of this invention to provide an improved shock tube initiating device having only a thermal input device and a length of shock tube for coupling to shock tube that is used for lead-in for the initiating of blasting caps, pyrotechnic charges, and other explosive materials cheaply, reliably, and relatively safely.

It is still another object of this invention to provide a thermal enhancing output device to convert the percussive energy of shock tube into a more sustained flame capable of igniting a relatively slow burning and flame producing fuse.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENTS

Figure 1:
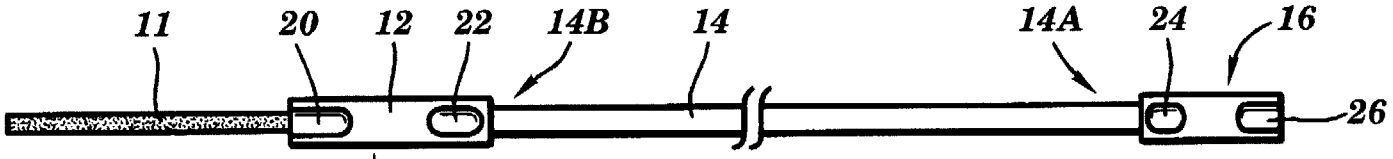
FIG. 1 is an elevated plan view of an embodiment of the present invention.

Referring now specifically to the drawings, there is illustrated a shock tube initiating system in accordance with the preferred embodiments of the present invention, wherein like reference numerals refer to like elements throughout the drawings.

Figure 2:
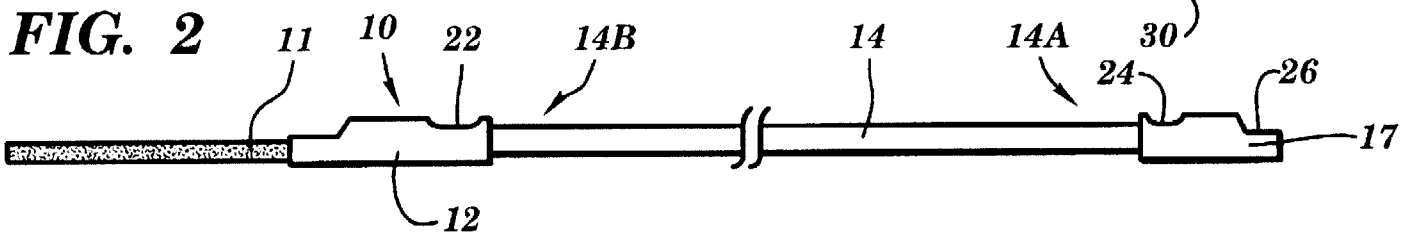
FIG. 2 is a side view of an embodiment of the present invention.

As shown in FIGS. 1 and 2, the present invention comprises a thermal input initiator device 10, a length of shock tube 14, and a thermal enhancing output device 16. The thermal input initiator device 10 comprises a fuse 11, a first tubular portion 12, and an amount of a pyrotechnic chemical mixture. The fuse 11 is held within the first tubular portion 12 by a first crimping dent 20. The amount of pyrotechnic chemical mixture (not shown) is placed within the first tubular portion 12 after the first crimping dent 20 has been made. Then a first end 14B of the length of shock tube 14 is placed within the first tubular portion 12 and held by a first staking dent 22.

Figure 3:
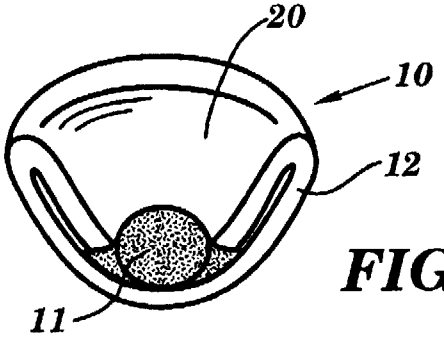
FIG. 3 is an end view of the thermal input initiator portion of the present invention.

As shown in FIG. 3 the fuse 11 is held within the first tube portion 12 by a first crimping dent 20. The fuse is preferably "Cordao Ignitor Mantitor" from Brazil, available at Coonie's Explosives, Box 2062, Hobbes, N.M. 88240, because this fuse is plastic coated and therefore is less susceptible to failure because of dampness, dew, or other moisture related problems. Additionally, the process of crimping the fuse is facilitated because the pyrotechnic material is plastic coated and it is more difficult to over-crimp and, thus, the crimp does not cut off the fuse or otherwise interfere with the burning performance of the fuse.

The first crimping dent 20 must be deep enough to form a seal with the fuse 11, but must not be so deep as to cut off the course of the ignition flame as it passes into the hollow inner chamber. To this end, it has been found that height of the optimal crimping dent 20 against the preferred fuse 11 of the first tubular portion 12 having an outer diameter of about 5/32" and a tube wall thickness of 0.014" should be approximately 0.050" as measured from the outside radius of the first tube portion 12 to the outside deepest portion of the crimp.

When this crimp 20 has been made, the amount of a pyrotechnic chemical mixture may be placed within the crimped first tubular portion 12. The pyrotechnic chemical mixture preferably comprises a low explosive, deflagrating chemical composition comprised of fuels, oxidizers, and binders. In particular, the mixture most preferably contains boron, calcium chromate, titanium, potassium perchlorate, and dextrin (hereinafter "BCTK"), although other low explosive pyrotechnical chemical mixtures known in the art may also be used. BCTK and compositions like it are preferable because they do not detonate or experience a high order explosion and are therefore not considered "primary explosives". Hence, they do not necessitate the use of more complex and costly mechanical initiation assemblies having sufficient strength to contain the high stress energies of primary explosives. Also, they are not sensitive to static electricity and thus do not require additional components such as static shields or barriers at the interfaces between shock tube and the composition in order to compensate for static electricity sensitivity and the hazards of accidental initiation presented by static electricity charging the shock tube plastics. The BCTK composition has been shown to withstand, without ignition, repeated electrical arc discharges from a 500 picoFarad capacitor charged to 20,000 volts applied in close proximity and directly to the BCTK composition.

In order to ignite the shock tube, it has been found that a granular powder charge of the BCTK composition is the most preferable with a grain size between approximately 25 mesh and 60 mesh. The granulation is performed by mixing the appropriate chemicals, dampening the mixture with water and then rubbing this over a 30 mesh screen. The fines may then be sifted out with a 60 mesh screen after drying. Between about 50 to about 70 mg of this granular powder charge are then loaded into the inner chamber of the first tubular portion. Approximately 65 mg of the granulated BCTK composition as disclosed herein appears to be the most optimal in the test runs to date yielding 100% reliability in initiating the shock tube. If too little of the composition is used, the risk of unreliability is increased. If too much BCTK is used, the risk of undesirable splitting of the shell or first tubular portion increases.

The length of shock tube 14 may then be inserted into the first tubular portion 12 and the first staking dent 22 is made to hold the first end 14B length of shock tube 14 in the first tubular portion 12. The first staking dent 22 also serves to sealably close the first tubular portion 12 around the shock tube 14. This must be accomplished in such a manner that the interior of the shock tube 14 is not pinched off because, if it were, it would no longer carry the percussive energy. Also, the first staking dent 22 should not be so loose as to allow the first tubular portion 12 to come off prematurely during the deflagration of the pyrotechnic chemical mixture because that would not allow for the build up of heat and pressure that is necessary to initiate the shock tube. Also, if the crimp is too loose, the explosion may dislodge and move the reactive explosive dusting powder on the interior of the length of shock tube 14 some distance down the tube, preventing the initiation of the shock tube. Therefore, it has been found that the depth of the first staking dent 22, measured from the outside radius of the first tubular portion opposite the stake dent to the outside deepest surface of the staking dent, is preferably between 0.108" and 0.112", given the outer diameter of the first tubular portion is approximately 5/32nds of an inch and the tube wall thickness is 0.014". The optimal first staking dent 22, measured as above, is 0.110" deep. This depth has been found to yield 100% reliability in field trials.

Although the shock tube alone may be utilized to initiate the shock tube lead in to commercial blasting caps, the percussive wave output of shock tube is incapable of reliably igniting pyrotechnic compositions alone. Therefore, in the preferred embodiment of the present invention a thermal enhancing output device 16 may be used at the terminal end 14A of the length of shock tube 14 to convert the percussive wave signal into thermal energy.

In one embodiment, the thermal enhancing output device 16 comprises a second tubular portion 17, preferably made of a soft aluminum material so as to avoid fracturing and the resulting shrapnel, and a second charge of a pyrotechnic chemical composition. The second charge of BCTK is chosen once again because it is relatively inert with respect to static electricity, electrical induction from lightning strikes, friction ignition, and the like, as discussed hereinbefore. However, this charge of BCTK need only be approximately 35 mg of the granulated powder as this is generally sufficient to ignite the pyrotechnic devices without causing the thermal enhancing device to fragment.

The second tubular portion is, like the first tubular portion, crimped and staked so as to allow the passage of the output impulse from the shock tube into the hollow chamber within the second tubular portion 17. Accordingly, the second staking dent 24 should be approximately equal to the dimensions of the first staking dent 22. So, given that the shock tube and outer diameter of the second tubular portion 16 are both about 5/32nds of an inch and that the tube wall thickness is 0.014", the depth of the staking dent 22 should be around 0.108 to 0.112", with the optimum depth being approximately 0.110".

Figure 4:
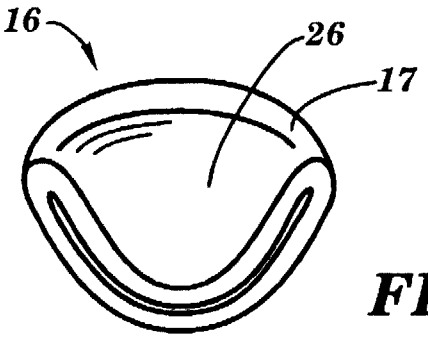
FIG. 4 is an end view of the thermal output enhancing device of the present invention.

The second crimping dent 26 may vary in depth as well but to obtain the optimal results, it is desirable to contain the BCTK and seal the internal chamber to protect the BCTK from moisture or contamination within the second tubular portion 17 as shown in FIG. 4.

Figure 5:
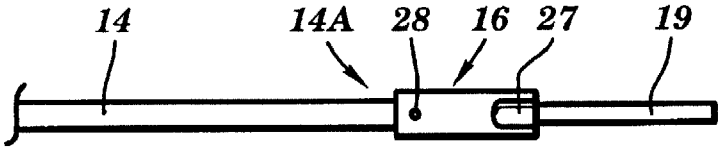
FIG. 5 is an elevated plan view of a first alternate embodiment of the thermal output enhancing device of the present invention.

In an alternative embodiment, the thermal enhancing output device 16 may comprise a length of fuse material 19 held within the adapted second tubular portion 17 by means of the second crimping dent 27, as shown in FIG. 5. In this case, the crimp must be deep enough to contain the deflagrating explosion long enough to ignite the fuse but it also must be shallow enough so as not to pinch off the fuse material. To this end, it has been found that the crimping dent 27 is optionally about 0.050" on average when the height of the finished crimping dent is measured from the outside radius of the aluminum tube opposite the crimp to the outside deepest surface of the crimp.

The thermal enhancing output device 16 of this alternative embodiment is assembled by taking a second tubular portion 17 and inserting a second igniter cord fuse 19 which may be the Brazilian "Cordao Ignitor Mantitor", available from Coonie's Explosives, Hobbes, N.M., as described above in the assembly of the thermal input initiating device 10, or may be any other pyrotechnic fuse train that can be stimulated to ignition from the impact of the shock tube signal as known in the art.

This igniter cord fuse 19 is optionally positioned inside the second tubular portion 17 such that one end is centered inside the second tubular portion 17 equal distance from the ends. The igniter cord fuse 19 is then crimped in place by means of a second crimping dent 27 such that the fuse 19 is fixed in place and a seal is formed.

A charge of a pyrotechnic chemical mixture is then introduced into the second tubular portion 17. This charge is preferably about 30 mg of a mixture of red lead oxide and silicon for 100% fuse ignition reliability.

The terminal end 14A of the length of shock tube 14 is then inserted into the unsealed end of the second tubular portion 17, such that it abuts the charge of the pyrotechnic chemical mixture. A venting hole, 28 is formed by radially piercing the second tubular portion 17 on one side approximately 1/8th of an inch from the end of the second tubular portion 17 into which the shock tube is inserted. When the piercing tool penetrates the second tubular portion 17, a burr (not shown) is created on the interior of the second tubular portion 17. This burr (not shown) digs into the length of shock tube 14 for securing the second tubular portion 17 to the length of shock tube 14. Thus the assembled thermal enhancing output device 16 is formed as shown in FIG. 5.

In operation, this device 16 receives the initiated shock tube signal front. The impact of the signal front against the pyrotechnic chemical mixture causes the ignition of the chemical mixture. This pyrotechnic chemical mixture then burns and conveys thermal conduction to the igniter cord fuse. When the signal front enters the second tubular portion 17, the excess energy is vented out of the venting hole 28. This, in addition to the grasping of the shock tube 14 by the burrs allows the thermal enhancing output device 16 to remain attached to the terminating end 14A of the length of shock tube 14. The igniter cord fuse material 19 is ignited and then burns through the shallower second crimping dent 27, thereby producing an output flame external to the second tubular portion 17. The duration of the output flame is determined by the burn rate and length of the affixed igniter cord fuse.

The use of this embodiment provides a non-deflagrating ignition stimulus, therefore possible display fireworks applications of the present invention are increased such as: igniting quickmatch leaders used to ignite lance work ground displays ("set piece"); display candles; gerbe devices; wheel devices; strobe pots; multiple tube "cake" devices; and other such devices because the second tubular portion 17 is not violently separated and projected from the shock tube 14, hence eliminating some of the potential damage to delicate fireworks assemblies in proximate attachment to the thermal enhancing output device.

Figure 6:
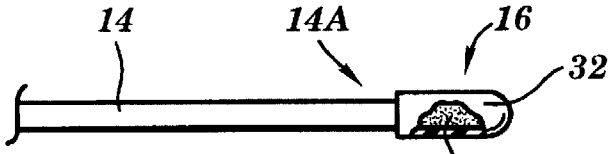
FIG. 6 is an elevated plan view of a second alternate embodiment of the thermal output enhancing device of the present invention.

In a second alternate embodiment, the thermal enhancing output device 16 comprises a cap device 32 and a charge of an explosive material 30 as shown in FIG. 6. The most preferred explosive charge is a 35 mg charge of BCTK as this charge has been found to be reliable and safe, however it should be understood that various explosive chemical compositions and varying amounts would also be suitable. This charge of BCTK is placed within the cap device and the open end of the thus-formed thermal enhancing output device 16 is then slipped over the terminating end 14A of the length of shock tube 14.

The cap device is preferably constructed out of a molded vinyl plastic which is thin-walled, hollow, and tubular in shape, having a longitudinal axial bore and a molded-in closure on one end. The inner diameter of the cap is approximately 112", the outer diameter is about 0.180", and the length is approximately 0.750" in the most preferred embodiment (manufactured by Mocap Comp., St. Louis, Mo.). This molded vinyl plastic cap device 32 expands to fit over the end of the shock tube 14 and is maintained in position by the interference fit with the outside diameter of standard shock tube. The cap 32 is positioned over the shock tube 14 so that the end of the shock tube 14 is proximate to the charge of explosive material 30.

This embodiment functions in a similar manner to the first embodiment. The fuse 11 is lit, which burns along its length creating a delay and then ignites the BCTK in the first tubular portion 12. The ignition of the BCTK creates a small deflagration explosion which initiates the length of shock tube 14. The percussive wave travels the length of shock tube 14 at a rate of 6,500 ft/sec. At the terminating end of the shock tube, the signal front enters the cap device 32 and impacts the BCTK 30 contained therein. A small deflagration explosion is experienced because of the impact energy from the shock tube and the rapidly expanding gases from the burning BCTK in the enclosed cap device 32. This small deflagration explosion causes the vinyl plastic cap device harmlessly rupture, scattering burning chemical particles thereby providing ignition energy stimulus to proximate fireworks assemblies or other pyrotechnic devices, such as firing aerial shells from a mortar gun.

One advantage of this embodiment is that this thermal enhancing output device is less expensive to produce because the materials are inexpensive and assembly requires less labor. Additionally, this device is more cost effective because the soft vinyl plastic cap device creates less potential for damage to delicate proximate firework assemblies. Another advantage of this embodiment is that when the cap device is manufactured from vinyl plastic, it forms a better moisture seal with the shock tube 14 than the alternative with the staking dent. For this reason, the effects of dew, dirt, and atmospheric humidity that may be detrimental to performance are precluded.

The embodiments disclosed herein have been discussed for the purpose of familiarizing the reader with the novel aspects of the invention. Although preferred embodiments of this invention have been shown and described, many changes, modifications, and substitutions, such as: alternative charge chemicals; alternative materials instead of soft aluminum tubing; various types of shock tube; lengths of the thermal input initiator device, shock tube, and thermal enhancing output devices may be varied; and the amount of charge necessary may be adjusted up or down depending upon the new chamber size, may be made by one having ordinary skill in the art without departing from the scope of the invention as described in the following claims.

I claim:

1. An apparatus comprising:

a input initiator device wherein an amount of a chemical composition is enclosed therein, said chemical composition having the characteristics of a BCTK composition which provides a deflagrating, percussive shock explosion upon ignition;

an output device, wherein an amount of said chemical composition is enclosed therein; and a length of high velocity shock tube wherein the input initiator device is operably coupled to a first end of the length of shock tube and the output device is operably coupled to a second end of the length of shock tube.

2. The apparatus of claim 1, wherein the input initiator device comprises;

a fuse;

a first tubular portion; and an amount of said chemical composition, wherein the fuse is operably held by an operable connection with the first tubular portion and said chemical composition is loaded into the first tubular portion.

3. The apparatus of claim 2, wherein the fuse is made of a plastic coated fuse material.

4. An apparatus comprising:

a length of high velocity shock tube; and a output device operably coupled to the length of high velocity shock tube, wherein an amount of a chemical composition is enclosed within said output device, said chemical composition having the characteristics of a BCTK composition which provides a deflagrating percussive shock explosion upon ignition.

5. The apparatus of claim 1, wherein said chemical composition comprises: boron; calcium; chromate; titanium, potassium perchlorate; and dextrin.

6. The apparatus of claim 5, wherein the amount of chemical composition is a granular powder.

7. The apparatus of claim 2, wherein the operable connection is a first crimping dent.

8. The apparatus of claim 1, wherein the input initiator device is operably coupled to the length of shock tube by means of a second staking dent.

9. The apparatus of claim 1, wherein the output device is operably coupled to the length of shock tube by means of a second staking dent.

10. The apparatus of claim 1, wherein, the output device comprises: a second tubular portion; and an amount of said chemical composition loaded within the second tubular portion.

11. The apparatus of claim 10, wherein the second tubular portion is operably coupled to the length of shock tube by means of a second staking dent.

12. The apparatus of claim 10, wherein the second tubular portion is operably coupled to the length of shock tube by means of a burr.

13. The apparatus of claim 11, wherein the second tubular portion is functionally sealed at the end opposite the second staking dent by means of a second crimping dent.

14. The apparatus of claim 12, further comprising a length of fuse material operably held within and extending from the second tubular portion.

15. The apparatus of claim 14, wherein the length of fuse material is operably held within the second tubular portion by means of a second crimping dent.

16. The apparatus of claim 1, wherein the output device comprises: a cap device; and a charge of an explosive material.

17. The apparatus of claim 16, wherein the cap device is a thin-walled, hollow, molded vinyl plastic tube having a longitudinal bore and a molded-in closure on one end which is operably coupled to the shock tube by an interference fit.

18. The apparatus of claim 1, wherein the input initiator device comprises:

a fuse;

a first tubular portion; and an amount of said chemical composition, wherein the fuse is operably held by an operable connection within the first tubular portion and said chemical composition is loaded into the first tubular portion and wherein the output device comprises:

a second tubular portion; and an amount of said chemical composition load within the second tubular portion.

19. An apparatus comprising:

an input initiator device containing an amount of a chemical composition having the characteristics of a BCTK composition which provides a deflagrating, percussive shock explosion upon ignition; and a length of high velocity shock tube operably coupled to the input initiator device.

20. The apparatus of claim 18, wherein the thermal enhancing output device is operably coupled to the length of shock tube by means of a second staking unit having an optimal depth of approximately 70% of the outer diameter of the first tubular portion.

21. The apparatus of claim 18, wherein the operable connection is a first crimping dent having an optimal height of approximately 30% of the outer diameter of the first tubular portion.

22. The apparatus of claim 18, wherein the thermal input initiator device is operably coupled to the length of shock tube by means of a first staking dent having an optimal depth of approximately 70% of the outer diameter of the first tubular portion.

* * * * *